US005677017A

United States Patent [19]

Freeman

[11] Patent Number: 5,677,017

[45] Date of Patent: Oct. 14, 1997

[54] NATURAL TREE CAMOUFLAGE MATERIAL

[76] Inventor: Barry G. Freeman, 105 Sharonview St., Fort Mill, S.C. 29715

[21] Appl. No.: 603,238

[22] Filed: Feb. 20, 1996

[51] Int. Cl.[6] ..... F41H 3/00

[52] U.S. Cl. ..... 428/17; 428/18; 428/919

[58] Field of Search ..... 428/15, 17, 18, 428/919

[56] References Cited

U.S. PATENT DOCUMENTS

| | | | |
|---|---|---|---|
| 129,441 | 7/1872 | Waring | 428/17 X |
| 437,431 | 9/1890 | Goodale | 428/18 |
| 657,050 | 8/1900 | Bick et al. | 428/18 |
| 1,139,642 | 5/1915 | Cox | 428/919 X |
| 2,218,740 | 10/1940 | Burke | 428/18 X |
| 2,660,826 | 12/1953 | Bennett | 428/919 X |
| 2,779,058 | 1/1957 | Hyde | 428/18 X |
| 2,992,503 | 7/1961 | Webb | 428/919 X |
| 3,977,927 | 8/1976 | Amos et al. | 428/919 X |
| 4,106,124 | 8/1978 | Green | 428/919 X |
| 4,106,233 | 8/1978 | Horowitz | 428/151 X |
| 4,517,230 | 5/1985 | Crawford | 428/17 |
| 4,656,065 | 4/1987 | Yacovella | 428/17 |
| 4,792,471 | 12/1988 | Lee | 428/17 |
| 5,271,888 | 12/1993 | Sinsley | 264/87 |
| 5,445,863 | 8/1995 | Slagle et al. | 428/17 X |

*Primary Examiner*—Henry F. Epstein
*Attorney, Agent, or Firm*—Shefte, Pinckney & Sawyer

[57] ABSTRACT

Natural tree camouflage sheet material having a three-dimensional camouflage effect for use in clothing shelters, blinds and other general purpose camouflage applications includes a sheet of three-dimensional camouflage material having the appearance of natural tree bark and including a molded portion with the molded portion being formed from a pliant material molded into a natural tree bark configuration taken from a negative relief mold, the negative relief mold being obtained from an impression of the bark from a natural tree.

5 Claims, 3 Drawing Sheets

NATURAL TREE CAMOUFLAGE MATERIAL

BACKGROUND OF THE INVENTION

The present invention relates broadly to camouflage material for concealment of people or objects and, more particularly, to a natural tree camouflage material which provides a three-dimensional camouflage effect which, when used properly, can virtually totally conceal a person or object.

Camouflage material is widely used by hunters, the military and others who seek concealment in wooded or other natural areas. Generally, camouflage material has a predetermined disrupted pattern of coloration similar to the coloration found in wooded areas or other areas for which the camouflage is designed. Hunters and the military commonly use wooded area-type camouflage but the military additionally uses desert camouflage or arctic camouflage. The best camouflage disrupts the lines of the object to which it is attached such that the object blends into the background and, from a distance, is typically not seen absent some form of irregular movement.

Several attempts have been made to construct three-dimensional camouflage material for clothing. For example, in Crawford U.S. Pat. No. 4,517,230 and Lee U.S. Pat. No. 4,792,471, camouflage material is constructed from artificial foliage attached to an article of clothing as in Crawford or the person itself as in Lee. For such camouflage to be effective, it must be used in such a volume as to severely restrict the movement of the wearer and is typically more suited to stationary objects or vehicles.

Another approach to three-dimensional camouflage offers a depth along the surface thereof which is absent from printed, color-only camouflage and does not restrict movement. For example, in Slagle et al U.S. Pat. No. 5,445,863, camouflage sheet material is formed by sandwiching a resilient core material between an inner and outer layer of fabric and providing a series of irregularly spaced seams across the material to define ridges and valleys which form a three-dimensional effect. The Slagle et al camouflage may be patterned with different colors or shadings for greater realism. A similar construction is provided in Yacovella U.S. Pat. No. 4,656,065 which attempts to simulate a tree with rough, highly elongated vertical ribs of a first shaded earth tone and vertical channels of a second darker earth tone to simulate tree bark. However effective such camouflage is to manufacture, it does not provide the realism at a natural tree bark surface would provide. However, natural tree bark is typically too brittle and delicate to attach to clothing for any length of time. Therefore, there exists a need to provide a natural tree, three-dimensional camouflage.

SUMMARY OF THE INVENTION

It is accordingly an object of the present invention to provide a natural tree camouflage material which addresses the above problems. It is further an object of the present invention to provide such a natural tree camouflage material that is easy to manufacture and is readily adaptable for use in clothing, shelters, and other applications requiring a pliant camouflage material having good insulation properties and sufficient flexibility.

To that end, natural tree camouflage sheet material having a three-dimensional camouflage effect for use in clothing, shelters, blinds and other general purpose camouflage applications includes a sheet of three-dimensional camouflage material having the appearance of natural tree bark and including a molded portion, the molded portion being formed from a pliant material molded into a tree bark configuration taken from a negative relief mold with the negative relief mold being obtained from an impression of the bark from a natural tree.

It is preferred that the camouflage sheet material include a substrate affixed to the molded portion with the substrate being formed from a flexible material. Preferably, the camouflage material is adhesively bonded to a textile substrate and a resulting combination of textile and camouflage material is formed into clothing for hunting.

It is preferred that the camouflage material be formed from molded rubber with the molded rubber being colored to resemble natural tree bark. It is further preferred that the mold for forming the sheet material be formed from plastic auto body filler material, commonly known as "BONDO®." "BONDO"® is a registered trademark of DYNATRON/BONDO Corporation of Atlanta, Ga.

The present invention also provides a method for forming natural tree camouflage sheet material having a three-dimensional effect for use in hunting clothing, blinds and other general Camouflage applications. The method includes the steps of providing at least one natural tree having bark formed thereon; providing a receptacle containing a moldable substance capable of being formed into a conforming relation with the tree bark; placing the moldable material into abutment with the tree bark; removing the moldable material from the bark, thereby creating a negative impression of the bark within the receptacle; inserting a second moldable substance into the negative relief mold, the second moldable substance being flowable under predetermined conditions to conform to the shape of the tree bark impression within the mold; and removing the second moldable substance from the negative relief tree mold with the second moldable substance becoming pliant a predetermined time period after removal from the mold under predetermined conditions thereby forming a pliant reproduction of the tree bark. The method preferably further includes the steps of affixing a plurality of the camouflage molded portions to a textile substrate and forming a resulting camouflage material and substrate combination into clothing.

It is further preferred that the step of providing a second moldable substance includes providing a rubber substance for insertion into the mold obtained through its use.

By the above, the present invention provides a pliant camouflage material having an extremely realistic appearance thereby enhancing the camouflage effect.

DETAILED DESCRIPTION OF THE PREFERRED EMBODIMENT

Figure 1:
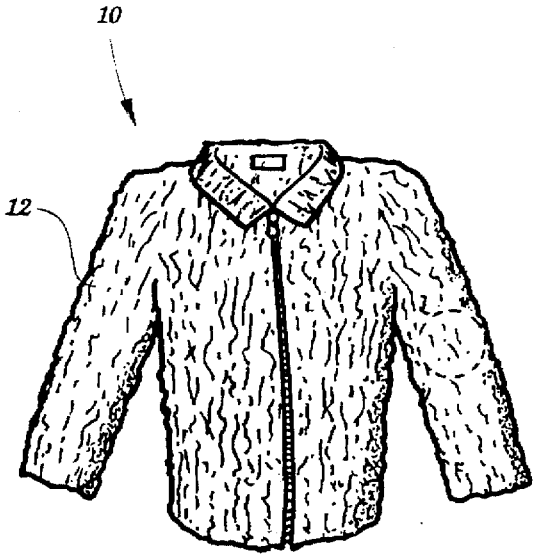
FIG. 1 is an elevational view of an article of clothing formed from camouflage material according to the preferred embodiment of the present invention.
Figure 2:
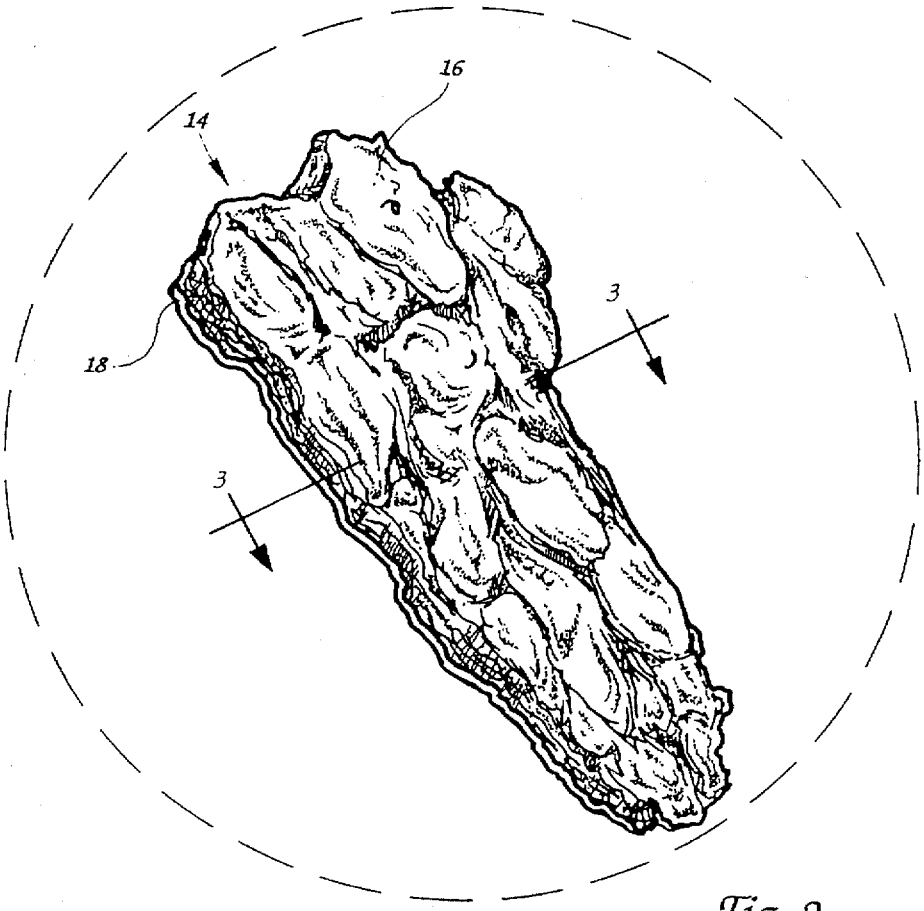
FIG. 2 is a perspective view of a molded portion of camouflage material as seen in FIG. 1.
Figure 3:
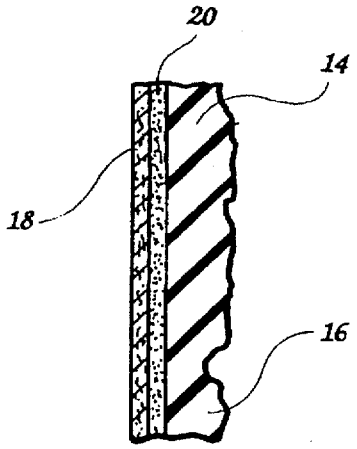
FIG. 3 is a cross-sectional view of the molded portion illustrated in FIG. 2, taken through line 3—3 thereof.

Turning now to the drawings and more particularly to FIG. 1, clothing formed with camouflage material according to the preferred embodiment of the present invention is illustrated generally at 10 and is formed as a jacket 12. The jacket 12 is formed from a plurality of molded simulated tree bark portions 14 having a natural tree bark surface 16, as illustrated in the magnified portion of FIG. 1. As seen in FIG. 2, a molded portion 14 provides an exact replica of a tree bark surface 16 and is attached to a flexible substrate 18. Optionally, the material may be used without a substrate by using a tough flexible rubber. Nevertheless, it is not recommended to form clothing from the camouflage material without a textile substrate. The molded portion 14 will typically have a somewhat irregular shape in addition to its unique unnatural surface contour so that a plurality of such molded portions may be assembled and affixed to a substrate 18 using adhesive 20 as seen in FIG. 3. The width of the adhesive 20 illustrated in FIG. 3 is exaggerated for clarity. The molded portion 14 is typically formed from a rubber material.

Figure 4:
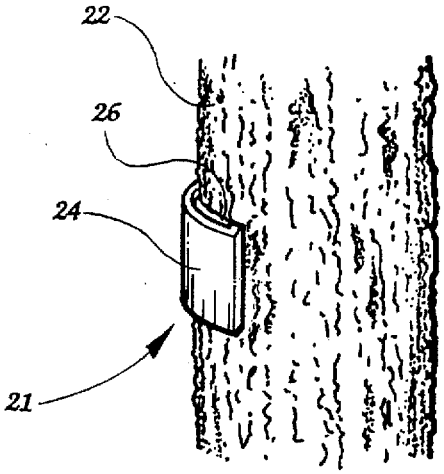
FIG. 4 is an elevational view of a natural tree having a mold attached thereto according to the preferred method of the present invention.
Figure 5:
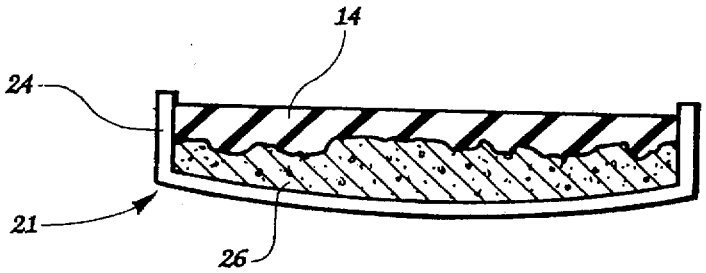
FIG. 5 is cross-sectional view of the mold illustrated in FIG. 4.

As seen in FIG. 5, a mold 21 is provided for forming the molded portion 14. There, a receptacle 24 of any convenient size and configuration is partially filled with the mold material 26 which is conveniently available in the form of plastic auto body filler known as "BONDO®." The plastic auto body filler is particularly suited for the present application in that it will not stick to the tree bark while providing substantially complete coverage of the tree bark, resulting in a detailed, realistic mold. The mold 21 is then placed against a tree 22 a seen in FIG. 4 until the moldable material 26 is dry. The mold 21 is then removed from the tree leaving a negative impression of the tree bark in the plastic auto body filler mold material 26 within the receptacle 24. This mold 21 may be used repeatedly to form several molded portions 14 which are collected and adhesively applied to a textile substrate to provide the camouflage sheet material. Once the mold is formed, liquidized rubber may be poured thereinto and allowed to dry to form the molded portion 14.

Figure 6:
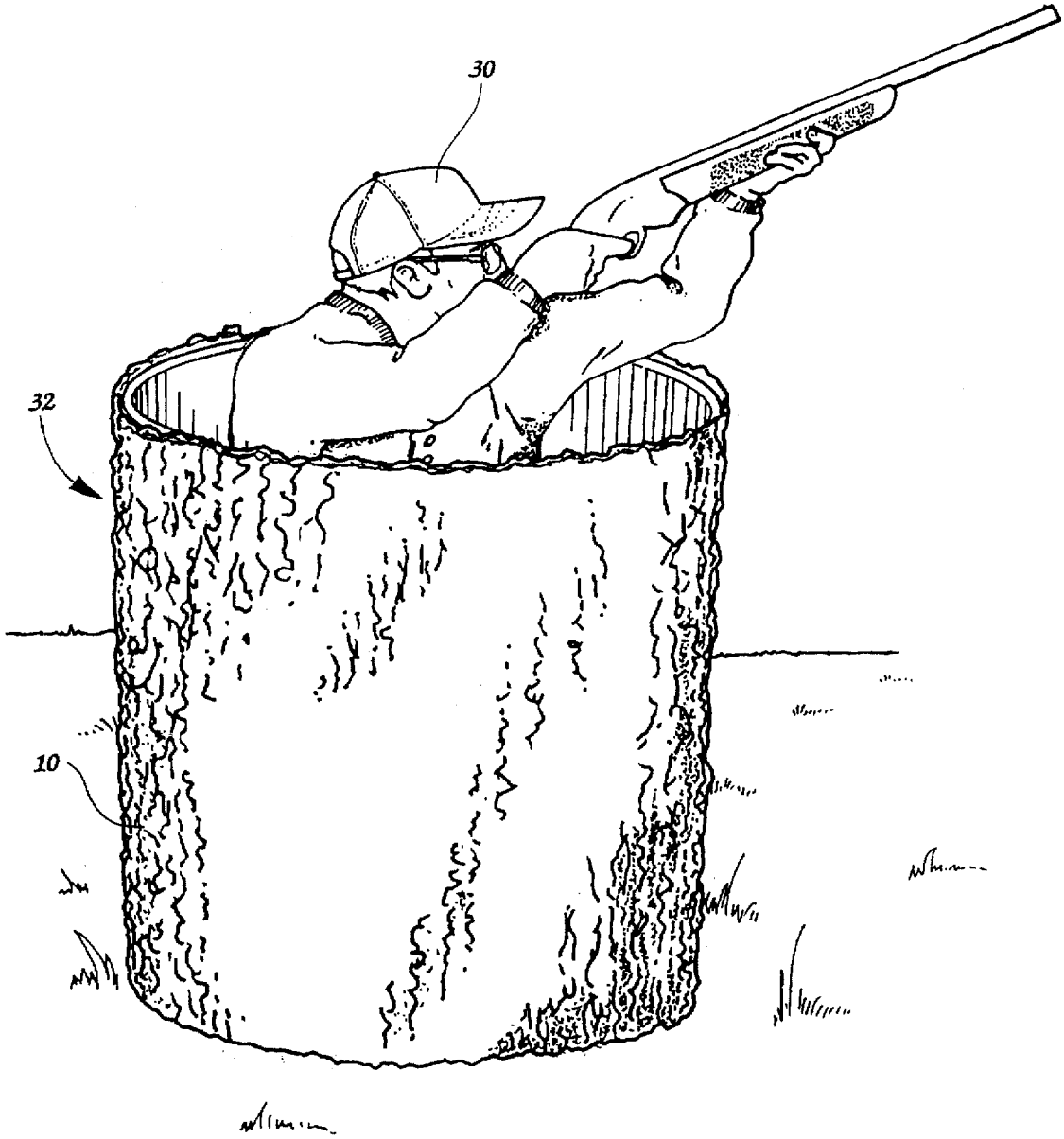
FIG. 6 is an elevational view of a hunting shelter formed using camouflage sheet material according to the preferred embodiment of the present invention.

Another use for the camouflage sheet material of the present invention may be found in FIG. 6. There, the material 10 is wrapped around a cylindrical frame 34 to form a blind or shelter for a hunter 30. As may be expected, the hunter 30 appears to be emerging from a tree trunk. The present invention is useful for many applications including the hunting clothing as seen in FIG. 1, as well as tents, gun cases, vehicles and the like. If the hunter chooses a jacket 12, pants and gloves, the hunter blends in to the background to become similar to any other tree in the forest. The present invention provides a camouflage material which is extremely effective in producing the desired camouflage effect in a wooded setting. Further, when used for clothing, the material retains body heat, is scent resistant, durable, semi-water resistant, easy to maintain, and retains its shape and configuration. Further, a variety of tree species may be used to provide differing effects.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Natural tree camouflage sheet material having a three-dimensional camouflage effect, for use in clothing, shelters, blinds and other general purpose camouflage applications, said camouflage sheet material comprising a sheet of three-dimensional camouflage material having the appearance of natural tree bark and including a molded portion, said molded portion being formed from a pliant material molded into a natural tree bark configuration taken from a negative relief mold, said negative relief mold being obtained from an impression of the bark from a natural tree.

2. Natural tree camouflage sheet material according to claim 1 and further comprising a substrate affixed to said molded portion, said substrate being formed from flexible material.

3. Natural tree camouflage sheet material according to claim 2 wherein said camouflage material is adhesively bonded to a textile substrate and a resulting combination of textile and camouflage material is formed into clothing for hunting.

4. Natural tree camouflage sheet material according to claim 1 wherein said camouflage material is formed from molded rubber, said molded rubber being colored to resemble natural tree bark.

5. Natural tree camouflage sheet material according to claim 1 wherein said mold is formed from plastic auto body filler material.

* * * * *